US005171971A

United States Patent [19]

Naylor et al.

[11] Patent Number: 5,171,971

[45] Date of Patent: Dec. 15, 1992

[54] YARN HEATING ARRANGEMENT

[75] Inventors: Geoffrey Naylor; Denys W. Brough, both of Macclesfield, United Kingdom

[73] Assignee: Rieter-Scragg Limited, Macclesfield, United Kingdom

[21] Appl. No.: 782,343

[22] Filed: Oct. 24, 1991

[30] Foreign Application Priority Data

Oct. 27, 1990 [GB] United Kingdom ..... 9023549

[51] Int. Cl.[5] ..... F26B 13/12; F27B 9/28

[52] U.S. Cl. ..... 219/388

[58] Field of Search ..... 219/388, 216, 469, 470, 219/471; 392/417

[56] References Cited

U.S. PATENT DOCUMENTS

| | | | |
|---|---|---|---|
| Re. 30,159 | 11/1979 | Kubler | 57/291 |
| 1,991,171 | 2/1935 | Newton | 219/388 |
| 2,780,047 | 2/1957 | Vandamme | 219/388 |
| 3,472,011 | 10/1969 | Scragg | 219/388 |
| 3,584,846 | 7/1971 | McCoy | 263/3 |
| 3,723,709 | 3/1973 | Forshee | 219/388 |
| 3,728,518 | 4/1973 | Kodaira | 219/388 |
| 3,743,868 | 10/1974 | Whittaker | 217/470 |
| 4,147,922 | 4/1979 | Naeser | 219/216 |
| 4,513,516 | 4/1985 | Bjornberg | 34/41 |
| 4,697,919 | 10/1987 | Hertel | 219/216 |

FOREIGN PATENT DOCUMENTS

| | | |
|---|---|---|
| 221944 | 9/1924 | United Kingdom . |
| 700883 | 12/1953 | United Kingdom . |
| 1256517 | 12/1971 | United Kingdom . |
| 1280691 | 7/1972 | United Kingdom . |
| 1349940 | 4/1974 | United Kingdom . |
| 1483533 | 8/1977 | United Kingdom . |
| 2031963 | 4/1980 | United Kingdom . |

*Primary Examiner*—Teresa J. Walberg

*Attorney, Agent, or Firm*—Oblon, Spivak, McClelland, Maier & Neustadt

[57] ABSTRACT

In a textile machine, a yarn heating arrangement incorporates a channel whose bottom surface is heated and a door which closes the channel and on whose inner surface are mounted yarn guides providing a yarn path adjacent the heated surface when the door is closed and the yarn guides are disposed within the channel. The length of the heated yarn path, or the proximity of the yarn to the heated bottom surface of the channel is adjustable to vary the level of heating of the yarn, and the door can be opened for cleaning and threading. A pivotal elongate yarn guide prior to the heater or pivotal elongate cooling track after the heater allow variation of the point of yarn inlet to or yarn outlet from the heater.

20 Claims, 4 Drawing Sheets

YARN HEATING ARRANGEMENT

FIELD OF THE INVENTION BACKGROUND OF THE INVENTION

This invention relates to yarn heating arrangements, and in particular to arrangements for heating a yarn during the false-twisting stage of false-twist texturing process.

Discussion of the Background

To enable yarn to be false-twist crimped it is necessary to heat the yarn while it is in a twisted condition to a temperature sufficient for the yarn to retain the memory of its molecular orientation in that twisted condition when it is subsequently cooled and de-twisted. Such heating is conventionally effected by passing the yarn in contact with an elongate heating plate or adjacent an elongate heat source, the temperature of the plate or heat source, and the time taken for the yarn to pass in contact with the plate or adjacent the source, governing the temperature reached by the yarn. From an economic standpoint it is undesirable to run the yarn at a lesser through put speed than the maximum of which the machine is capable and such maximum speed is generally governed by mechanical considerations. Hence, in order that a machine having a predetermined heater length and a predetermined maximum throughput speed, may process yarns of differing materials, e.g. nylon or polyester, or of differing decitex, it has up to now only been practicable to alter the heater temperature.

However the practicable range of temperatures of processing such yarns is limited. The upper limit of temperature is governed, particularly in the case of yarn contact heaters, by the problem of the yarn melting and contaminating the surface of the heater. The lower limit of temperature is governed by contamination of the heater surface by spin finish on the supply yarn, such contamination causing frequent stopping of yarn processing on the machine in order that the machine can be cleaned. These limitations can have the effect of reducing the range of yarns which can practically and economically be processed on a given texturing machine.

SUMMARY OF THE INVENTION

It is an object of the present invention to provide a yarn heating arrangement which allows for a greater range of yarns, as regards materials and decitex, to be processed on a given textile machine, practically and economically, than has been possible heretofore.

The invention provides a yarn heating arrangement for a textile machine comprising an elongate heated surface and yarn guide means disposed relative to each other in operation to provide a yarn path which extends adjacent the heated surface, wherein the relative disposition of the heated surface and at least a part of the yarn path is adjustable to vary the level of heating of a running yarn when travelling along the yarn path.

The heated surface may be curved along its length, in which case the yarn guide means may be disposed in operation to guide a running yarn along a curved yarn path adjacent a concave heated surface of the heating arrangement.

The heated surface may comprise a base surface of a channel provided in a body of the heating arrangement, in which case the yarn guide means may be disposed in operation within the channel. The yarn guide means may be movable between an operating position adjacent the heated surface and a non-operating position remote from the heated surface. In that case the yarn guide means may be mounted on a door which is movable between an open position, in which the yarn guide means is in its non-operating position, and a closed position, in which the yarn guide means is in its operating position and the door closes the channel. The door may be pivotally mounted on the body of the heating arrangement. The guide means may comprise a plurality of yarn guides, and each yarn guide may have a plurality of mounting locations on the door or a plurality of mutually spaced yarn guiding surfaces. Alternatively the door may have a plurality of closed positions giving differing depths of the yarn guide means in the channel, or the channel may have a plurality of locations in the machine.

The heating arrangement may be mounted in a textile machine which comprises feed means operable to feed a yarn to the heating arrangement, and cooling means operable to guide the yarn from the heating arrangement. The cooling means may comprise an elongate plate with which the yarn is caused to run in contact and having an inlet end and an outlet end. The cooling plate means may be mounted in the textile machine so that its inlet end is movable longitudinally of the heating arrangement to vary the position at which the yarn leaves the yarn path which is adjacent the heated surface. The cooling plate may be pivotal about the outlet end thereof disposed remote from the heating arrangement, whereby the inlet end of the cooling plate may be moved along a trajectory adjacent the heated surface.

Additionally or alternatively the textile machine may comprise further guide means operable to guide a yarn from the feed means to the heating arrangement. The further guide means may be elongate and have an inlet end and an outlet end. The further guide means may be mounted in the textile machine so that its outlet end is movable longitudinally of the heating arrangement to vary the position at which the yarn joins the yarn path which is adjacent the heated surface. The further guide means may be pivotal about the inlet end thereof disposed adjacent the feed means, whereby the outlet end of the further guide means may be moved along a trajectory adjacent the heated surface.

The door may have a plurality of apertures therein and spaced longitudinally thereof, through which a yarn may be threaded to and from the yarn guide means.

BRIEF DESCRIPTION OF THE DRAWINGS

The invention will now be described further with reference to the accompanying drawings in which.

DESCRIPTION OF THE PREFFERED EMBODIMENTS

Figure 1:
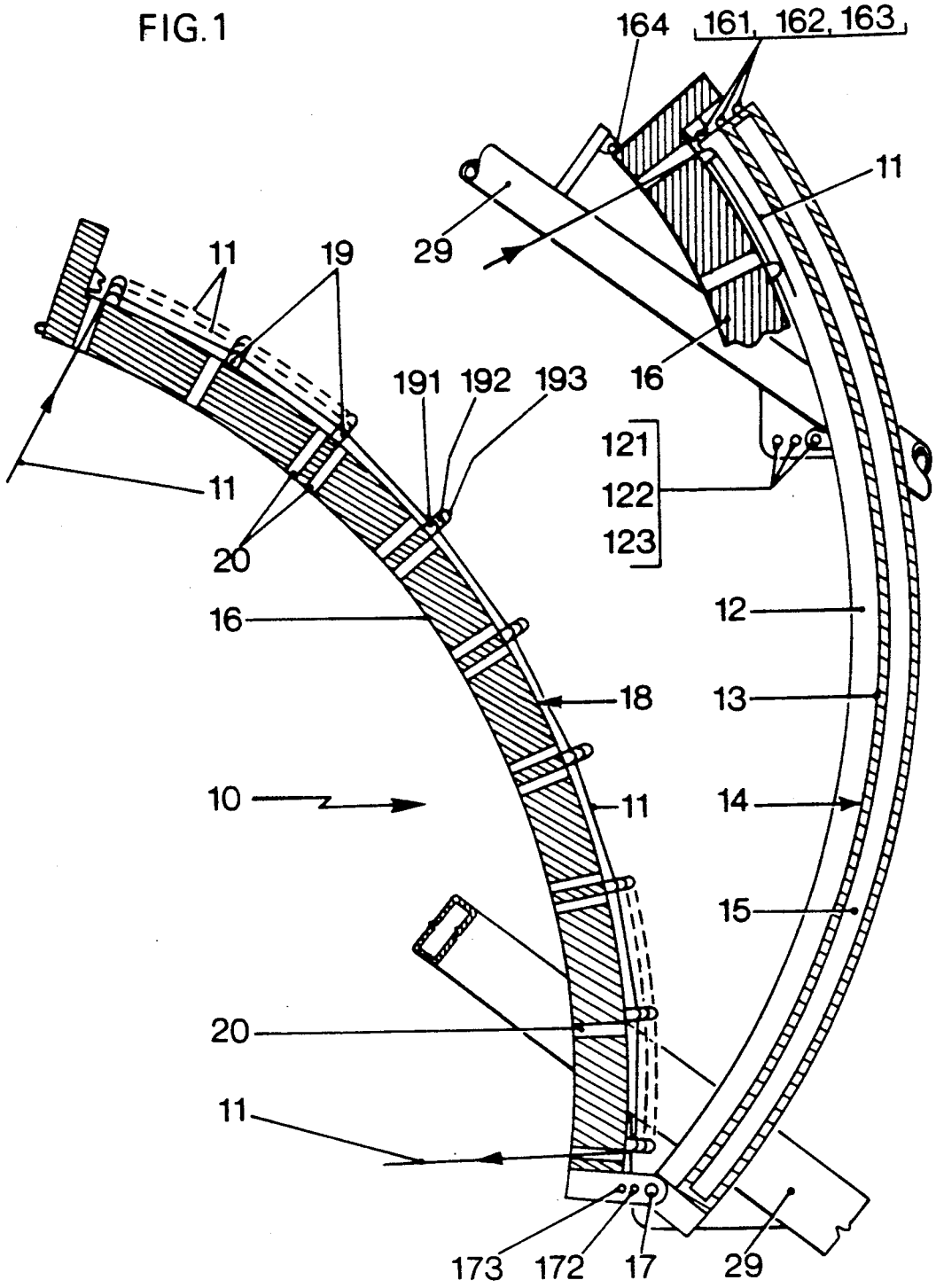
FIG. 1 is a longitudinal sectional view of a first embodiment of yarn heating arrangement.

Referring now to FIG. 1, there is shown a yarn heater 10 for heating a running yarn 11. The heater 10 comprises a channel 12, which in this embodiment has a curved bottom wall 13 providing a concavely curved bottom surface 14 to the channel 12. The bottom wall 13 also forms part of the body of the heater 10 in which there is a heating chamber 15 which may be heated in any known manner, for example by means of electrical heating elements housed in the chamber 15 in good thermal contact with the wall 13, by means of a heated fluid being passed through the chamber 15, or by the chamber 15 containing a vapor phase heating fluid and an electrical heating element therefor.

A door 16 is mounted on the channel/heating chamber 12, 15 so as to be pivotal relative thereto about an axis 17. The door 16 is curved to a curvature corresponding with that of the channel 12 so as to close that channel and prevent, to as large an extent as possible, loss of heat to the atmosphere from the heated bottom surface 14. Mounted on the inner surface 18 of the door 16 and spaced longitudinally thereof are plurality of yarn guides 19 to provide the guide means for the yarn 11, and adjacent each yarn guide 19 are one or two apertures 20.

The yarn 11 may be threaded through an aperture 20, over an appropriate number of yarn guides 19, and out through another appropriate aperture 20 to give a desired yarn path length within the heater 10. Such threading can be carried out with the door 16 in the open or non-operating position as shown in full in FIG. 1. When the door 16 is closed as shown only in part in FIG. 1, the yarn guides 19, and the yarn 11 passing over them, lie within the channel 12 adjacent the heated surface 14 with the yarn extending along a yarn path which is substantially of the same curvature as, and is substantially parallel with, the heated surface.

Since the yarn 11 does not run in contact with the heated surface 14, there is a much reduced tendency, compared with plate contact heaters, for contamination of the surface 14 by polymer or spin finish from the yarn 11. Any such contamination occurring on the yarn guides 19 may be readily cleaned when the door 16 is opened for threading purposes. Furthermore the heated surface 14, may be maintained at a temperature which is sufficient to ensure self cleaning of the surface 14, and/or of the guides 19 should any contamination occur thereon, e.g. 300° C. upwards for self-cleaning of the surface 14 and 400° to 420° C. or above for self-cleaning of the guides. The temperature of the yarn 11 as it leaves the heater 10 at a given throughput speed may be regulated upwardly by raising the temperature of the heated surface 14, or downwardly by reducing the yarn path length within the heater 10.

For example, 78 decitex nylon or 167 decitex polyester require an approximately 1 m heater length at the self cleaning temperature at a through-put speed of 8-900 m/min, whereas under the same conditions 44 decitex nylon or 78 decitex polyester require approximately 0.6 m heater length, and the 22 decitex nylon requires approximately 0.3 m heater length. Reduction of the yarn path length in the heater 10 for the finer decitex yarns allows the temperature to be maintained at or above the self-cleaning temperature, thereby reducing or eliminating the possibility of any contamination affecting the runability of the yarn 11 through the heater 10. Furthermore reduction of the yarn path length in the heater 10 increases the speed at which the yarn 11 can run without process instability, if the mechanical considerations of the machine concerned will allow such increase.

Instead of altering the yarn path length in the heater 10, the distance of the yarn path from the heated surface 14 may be varied. For this purpose each yarn guide 19 may have a plurality of yarn path locations, for example three such locations 191, 192 and 193 as illustrated. Alternatively guides 19 of differing heights may be mounted on the door 16 or each guide 19 may be mountable on the door in any one of several mounting positions. In the case illustrated the yarn 11 has been threaded onto the locations 191 nearest the inner surface 18 of the door, so that when the door is closed, the yarn path is at its furthest operating position from the heated surface 14, and the yarn 11 is therefore heated to the least extent. If the yarn 11 is threaded onto the intermediate locations 192, or the locations 193 furthest from the door inner surface 18, then the yarn path, shown in part in dashed lines, will be closer to the heated surface 14 when the door 16 is closed, and the yarn 11 will be heated to an intermediate extent or to the greatest extent respectively. With such an arrangement, the apertures 20 adjacent all but the endmost yarn guides 19 may not be required. A similar effect to that described above may be obtained by providing multiple locations 172, 173 of the hinge 17, to allow fixed location guides 19 to penetrate into the channel 12 to a greater or lesser depth as required. In addition with the door 16 hinged in at least two of the hinge locations 17, 172, 173 the yarn path through the heater 10 will not be parallel with the heated surface 14 but will converge therewith or diverge therefrom at a small angle. A similar effect can be achieved by maintaining a single hinge location 17 and providing a plurality of door closed latching locations 161, 162, 163 at the opposite end of the door 16 and heater body 10. Furthermore a similar effect can be achieved by maintaining a single hinge location 17 and a single door closed latching location 164 relative to the frame 29 of the textile machine in which the heater 10 is mounted, but having a plurality of locations 121, 122, 123 of the end of the channel 12 remote from the hinge 17 relative to the frame 29 of the textile machine. This latter arrangement has the advantage that the yarn path onto the cooling plate is unchanged when the heater channel 12 changes position.

Figure 2:
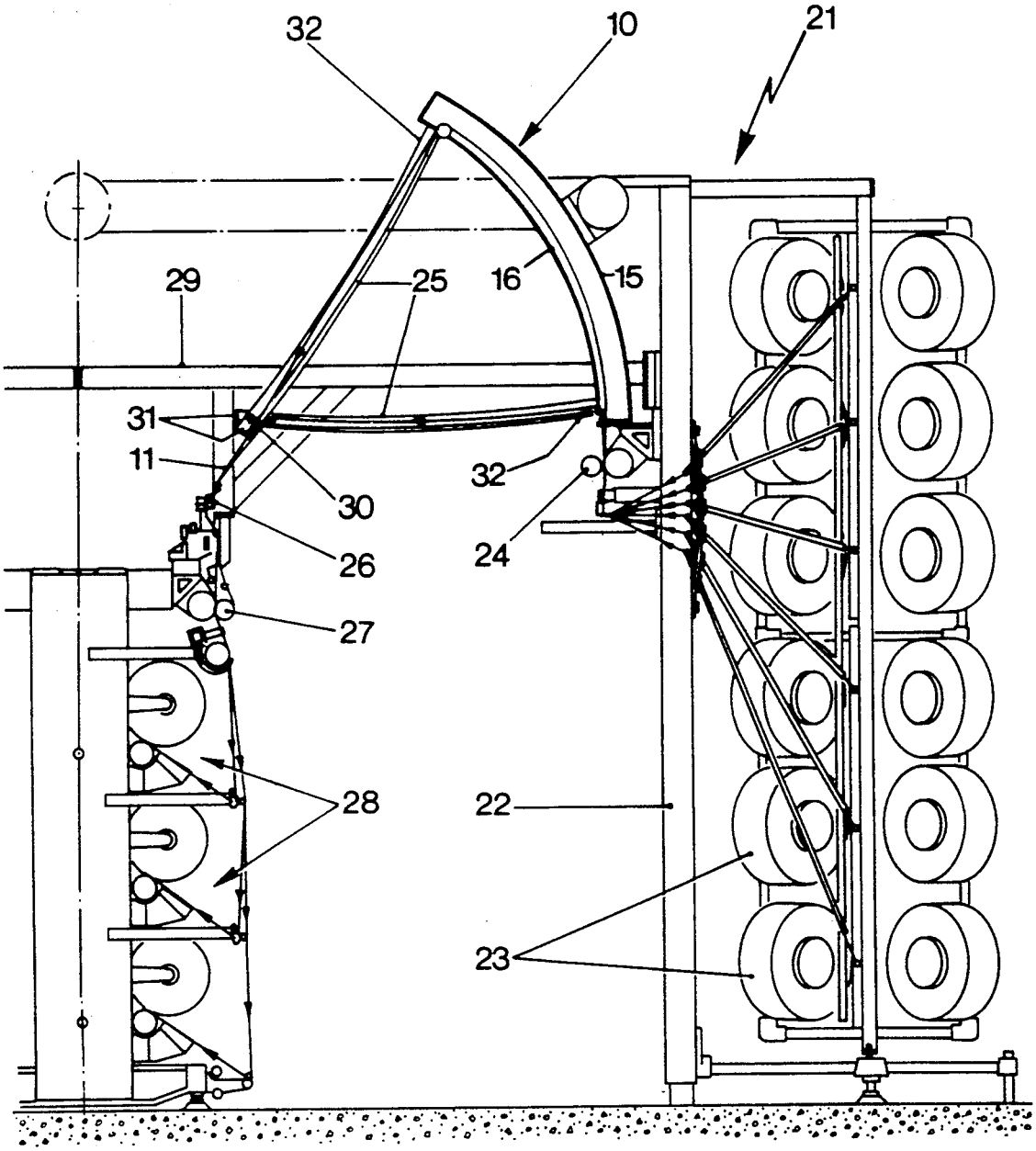
FIG. 2 is an illustration of one embodiment of textile machine incorporating the yarn heating arrangement of FIG. 1.

Referring now to FIG. 2, there is shown one embodiment of textile machine 21 in which a heater 10 is mounted. The machine 21 is a yarn texturing machine comprising in sequence a creel 22, in which packages 23 of supply yarn are mounted, a first feed means 24, a heater 10, a cooling means 25, a false-twist device 26, a second feed means 27, which may also draw the yarn 11, and wind-up means 28. The cooling means 25 comprises an elongate plate with which the yarn 11 is caused to run in contact after leaving the heater 10 so that the yarn 11 is cooled sufficiently to withstand the mechanical stresses to which it is subjected by the false-twist device 26, and to retain the twist memory when it is de-twisted after the false-twist device 26.

The cooling plate 25 is mounted on the frame 29 of the machine 21 so as to be pivotal about an axis 30 adjacent its outlet end 31 remote from the heater 10. In FIG. 2 the cooling plate 25 is shown in its two extreme positions of pivotal movement, one affording the maximum yarn path length in the heater 10, and the other affording the minimum yarn path length therein. The inlet end 32 of the cooling plate 25 may be slidingly engaged with the channel/chamber 12,15 of the heater 10 to facilitate such pivotal movement. By using the appropriate aperture 20 and pivoting the cooling plate 25 to the appropriate inclination, the length of the yarn path through the heater 10 can readily be adjusted to cater for the processing of any type and decitex of yarn 11.

Figure 3:
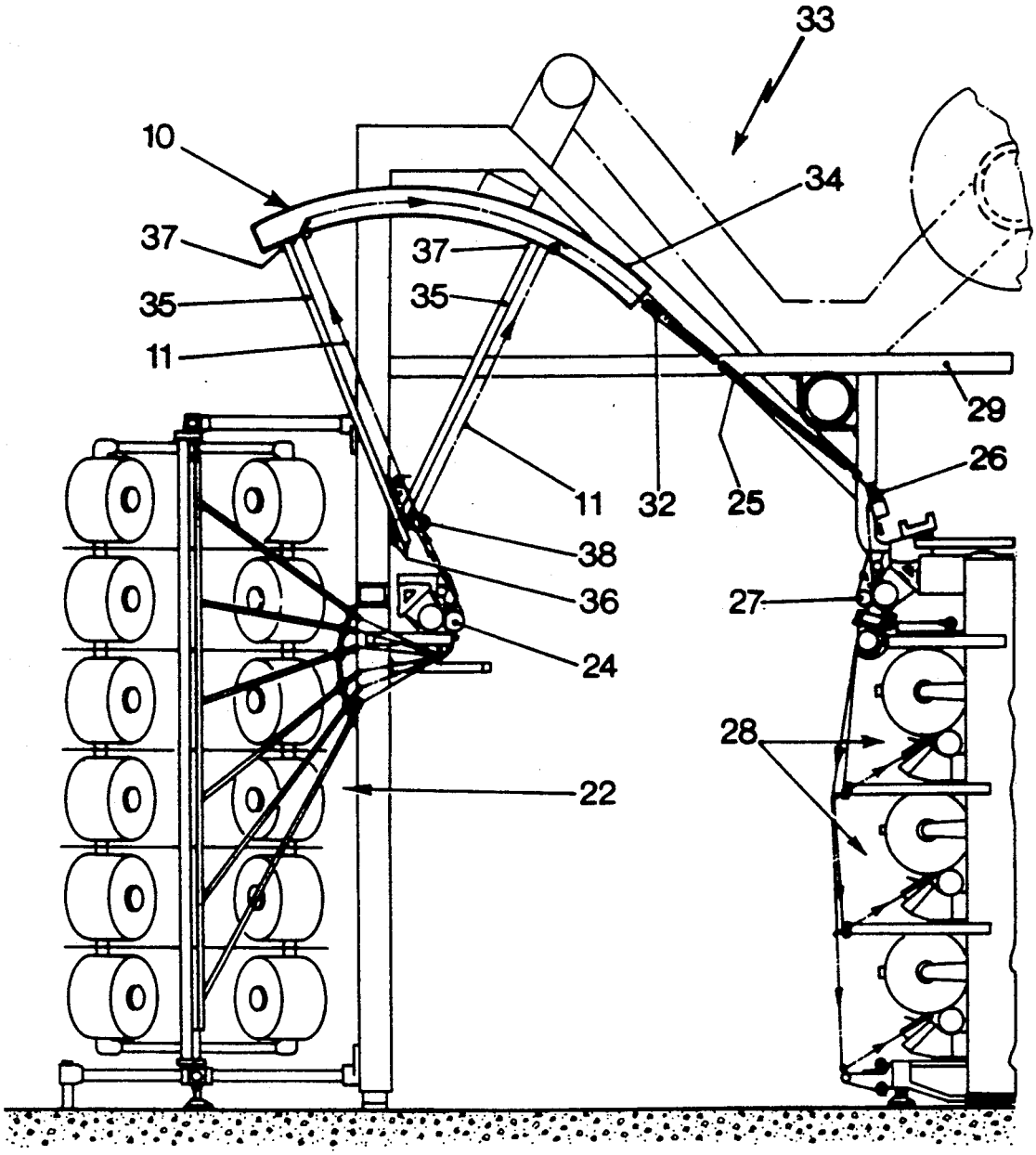
FIG. 3 is an illustration of a second embodiment of textile machine incorporating the yarn heating arrangement of FIG. 1.

Referring now to FIG. 3, there is shown an alternative embodiment of false twist texturing machine 33. Parts of the machine 33 which correspond with parts of machine 21 are identified by corresponding reference numerals. The machine 33 differs from the machine 21 in two principal respects. Firstly, in the case of machine 33 the cooling plate 25 is fixedly mounted on the frame 29, thereby allowing the inlet end 32 of the cooling plate 25 to be aligned with the exit end 34 of the heater 10, to avoid any possibly undesirable abrupt change in yarn path direction within the twist insertion zone. Secondly, a further guide means 35 is provided in machine 33 to guide the yarn 11 from the first feed means 24 to the heater 10. The further guide means 35 has an inlet end 36 adjacent the first feed means 24, and a outlet end 37 adjacent the heater 10. The further guide means 35 is mounted on the frame 29 so as to be pivotal about an axis 38 adjacent its inlet end 36, and is shown in FIG. 3 in two positions of its pivotal movement, one affording only a short yarn path length in the heater 10, and the other affording the maximum yarn path length therein. The outlet end 37 of the further guide means 35 may be slidingly engaged with the channel/chamber 12,15 of the heater 10 to facilitate such pivotal movement. By using the appropriate aperture 20 and pivoting the further guide means 35 to the appropriate inclination, the length of the yarn path through the heater 10 can readily be adjusted to cater for the processing of any type and decitex of yarn 11.

Figure 4:
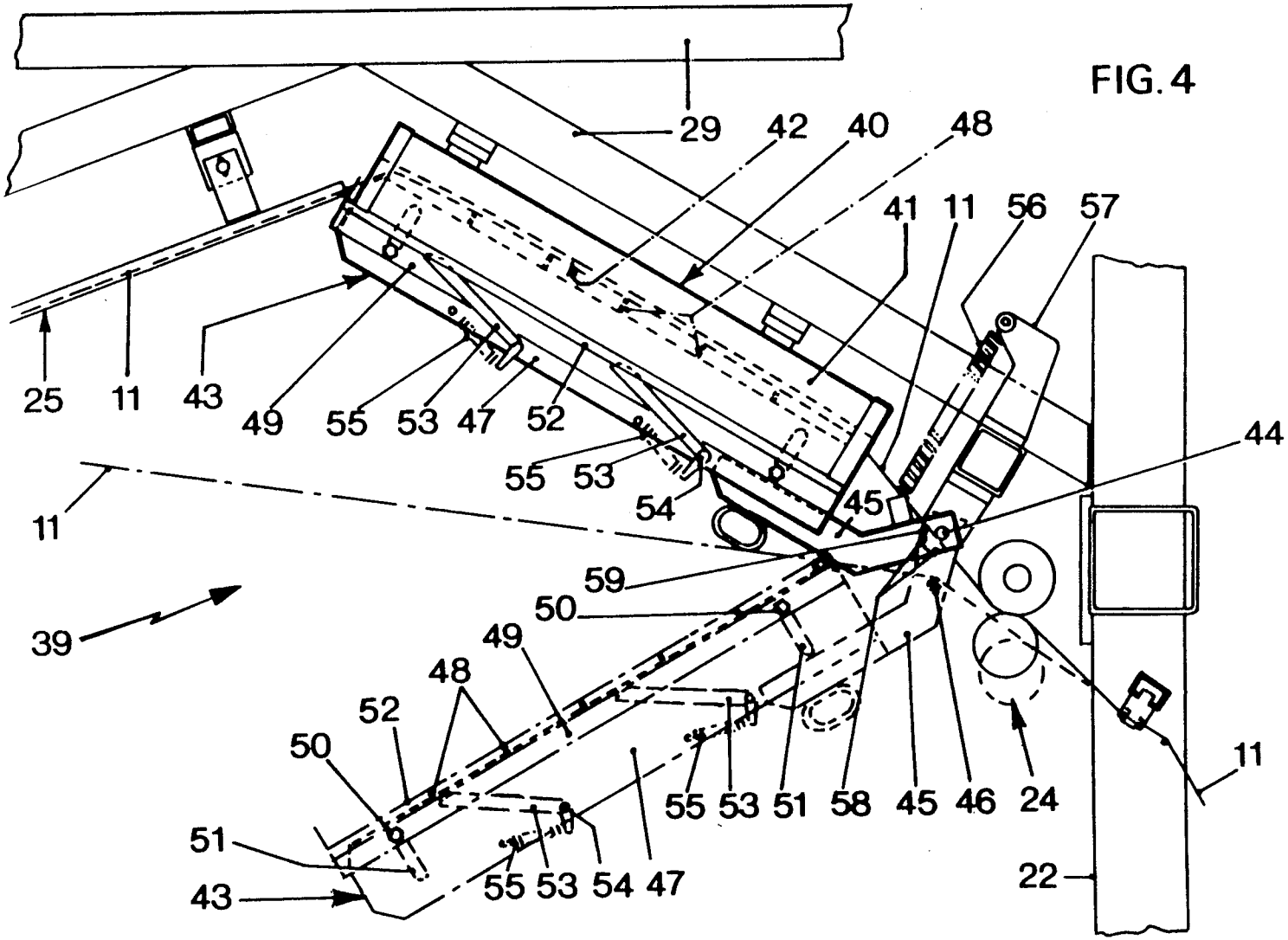
FIG. 4 is an illustration of a third embodiment of textile machine incorporating a second embodiment of yarn heating arrangement.

Referring now to FIG. 4, there is shown a part of a third embodiment of textile machine 39 in which a heater 40 is mounted. As with the previous embodiments, the machine 39 is a false twist texturing machine and has parts corresponding with those previously described and identified by the same reference numerals. In this embodiment, the heater 40 and the cooling plate 25 are fixedly mounted on the frame 29 of the machine 39. The heater 40 comprises a heater body 41 having a channel 42 extending along its length. The heater body 41 may be heated by known means as previously mentioned in relation to heater 10. The door 43 of the heater 40 has a mounting arm 45 which is pivotally mounted at pivot 44 on a door mounting bracket 57 on the frame 29, so that the door 43 is pivotal between a closed, operating position (shown in full lines) and an open, threading position (shown in broken lines). When the door 43 and the first feed means 24 are in the open, threading position the yarn 11 travels from the creel 22 through the open nip of the first feed means 24, over a guide pin 46 on the door mounting arm 45 and then directly to the false twist device (not shown in FIG. 4) without contacting the heater yarn guides 48 or the cooling plate 25.

The door 43 comprises a plate member 47 made of a good heat insulating material, which is attached to the mounting arm 45 and which is of a thickness such that it will just enter the channel 42 in the heater body 41 to substantially close it. Several yarn guides 48 are attached to the inner edge of the plate member 47, and are mutually spaced longitudinally of the heater 40 so as to guide the yarn along a yarn path adjacent the heated bottom surface of the channel 42 when the door 43 is in the closed, operating position. Also mounted on the plate member 47, on opposed faces thereof, are two side members 49 which are joined to each other by slider pins 50 passing through slide slots 51 in the plate member 47. A longitudinally extending lip 52 on one of the side members 49 is engaged by two cranked arms 53, each of which is pivotally mounted on the plate member 47 at pivots 54 and is biassed by a spring 55 to push the side members 49 to a position in which they lie on opposed sides of the yarn guides 48 to shield them and protect them from damage when the door 43 is in the open, threading position.

When the door 43 is moved from the open threading position, and the first feed means 24 is closed, the yarn 11 engages each yarn guide 48 successively further from the door pivot 44 and is moved to its operating position running adjacent the heated bottom surface of the channel 42 and in contact with the cooling plate 25. As the door 43 closes and the yarn guides 48 and the plate member 47 enter the channel 42, the side members 49 come into contact with the heater body 41 and are caused to slide relative to the plate member 47 as slider pins 50 move along the slide slots 51 and arms 53 rotate against the force of the springs 55. A spring 56 extending between the door mounting bracket 57, mounted on the machine frame 29, and the door mounting arm 45, biasses the door 43 towards this closed, operating position. To retain the door 43 in either the open or closed position, a spigot 58 is provided on the door mounting arm 45, and is engageable in recesses in the rim of a locator plate 59 provided on the door mounting bracket 57 concentrically with the pivot 44. By providing several such recesses, the position of the yarn guides 48 relative to the bottom of the channel 42 when the door 43 is closed may be selected to give the required extent of heating the yarn 11 for a given heater temperature.

Alternative embodiments of yarn heating arrangement in accordance with the invention will be readily apparent to persons skilled in the art, and embodiments of textile machine incorporating such yarn heating arrangements. For example heated fluid may be passed through the chamber formed by the channel 12 and the door 16, instead of heating the wall 13 from within chamber 15. The doors 16, 43 may be mounted to pivot about an axis parallel with the yarn path instead of the arrangements shown in FIGS. 1 or 4, or they may be slidable longitudinally of the channel 12. In this latter case insulation material may be slidable with the door 16 to provide that substantially all of the channel 12 is closed, irrespective of the position of the door 16, to reduce heat loss from any part of the heater 10 not being used to heat the yarn 11. Having regard to this latter embodiment the cooling plate 25 and/or the guide means 35 may be formed to a straight or curved configuration corresponding with that of the heater 10, and mounted so as to be slidable longitudinally thereof to vary the position at which the yarn leaves and/or joins the yarn path adjacent the heated surface 14. The inner surface 18 of the door 16, or inner edge of the plate member 47, and the sidewalls of the channels 12, 42 may be of reflective material to reflect heat radiating from the heated surface 14 towards the yarn 11. In the embodiment shown in FIG. 2 the cooling plate 25 may be curved upwardly and the yarn 11 run on the upper surface thereof, instead of the reverse, as illustrated, as a means of reducing the angle of wrap of the yarn 11 around the guide at the exit of the heater 10 and entry 32 of the cooling plate 25.

What is claimed is:

1. A yarn heating arrangement for a textile machine, comprising:

an elongate heated surface and a yarn guide means disposed relative to each other in operation to provide a yarn path which extends adjacent the heated surface, the relative disposition of the heated surface and at least a part of the yarn path being adjustable to vary the level of heating of a running yarn travelling along the yarn path; and a body having said heated surface, and a door having the yarn guide means mounted thereon, the body and the door being disposed relative to each other in operation to form a closed channel along which the yarn path extends adjacent the heated surface within the closed channel.

2. A yarn heating arrangement to claim 1, wherein the heated surface is concavely curved along its length, and wherein the yarn guide means is disposed in operation to guide a running yarn along a curved yarn path adjacent the concave heated surface of the heating arrangement.

3. A yarn heating arrangement according to claim 1, wherein the channel is provided in the body, the channel having a base surface, wherein the heated surface comprises the base surface of the channel, and wherein the yarn guide means is disposed in operation within the channel.

4. A yarn heating arrangement according to claim 3, wherein the door is movable between an open position, in which the yarn guide means is in a non-operating position remote from the heated surface, and a closed position in which the yarn guide means is in an operating position adjacent the heated surface and the door closes the channel.

5. A yarn heating arrangement according to claim 4, wherein the door is pivotally mounted on the body of the heating arrangement.

6. A yarn heating arrangement according to claim 4, wherein the yarn guide means comprises a plurality of yarn guides.

7. A yarn heating arrangement according to claim 6, wherein each yarn guide has a plurality of mutually spaced yarn guiding surfaces.

8. A yarn heating arrangement according to claim 4, wherein the door has a plurality of closed positions giving differing depths of the yarn guide means in the channel.

9. A yarn heating arrangement according to claim 8, wherein the door has a plurality of hinge positions on the body of the heating arrangement.

10. A yarn heating arrangement according to claim 4, wherein at least one end of the channel is movable between a plurality of locations in the machine.

11. A yarn heating arrangement according to claim 1, mounted in a textile machine which comprises feed means operable to feed a yarn to the heating arrangement, and cooling means operable to guide the yarn from the heating arrangement.

12. A yarn heating arrangement according to claim 11, wherein the cooling means comprises an elongate plate with which the yarn is caused to run in contact and which has an inlet end and an outlet end, and wherein the cooling plate is mounted in the textile machine so that its inlet end is movable longitudinally of the heating arrangement to vary the position at which the yarn leaves the yarn path which is adjacent the heated surface.

13. A yarn heating arrangement according to claim 12, wherein the cooling plate is pivotal about the outlet end thereof disposed removed from the heating arrangement, whereby the inlet end of the cooling plate may be moved along a trajectory adjacent the heated surface.

14. A yarn heating arrangement according to claim 11, wherein the textile machine comprises further guide means operable to guide a yarn from the feed means to the heating arrangement, and wherein the further guide means is elongate and has an inlet end and an outlet end.

15. A yarn heating arrangement according to claim 14, wherein the further guide means is mounted in the textile machine so that its outlet end is movable longitudinally of the heating arrangement to vary the position at which the yarn joins the yarn path which is adjacent the heated surface.

16. A yarn heating arrangement according to claim 15, wherein the further guide means is pivotal about the inlet end thereof disposed adjacent the feed means, whereby the outlet end of the further guide means may be moved along a trajectory adjacent the heated surface.

17. A yarn heating arrangement according to claim 4, wherein the door has a plurality of apertures therein and spaced longitudinally thereof through which a yarn may be threaded to and from the yarn guide means.

18. A yarn heating arrangement according to claim 4, wherein the door comprises a plate member of a thickness such that it will enter the channel to substantially close it, and has the yarn guide means attached to the inner edge of the plate member.

19. A yarn heating arrangement according to claim 18, wherein the plate member has opposed faces and slots therethrough, and has two side members mounted on the opposed faces, the two side members being connected to each other by slider pins passing through the slots in the plate member.

20. A yarn heating arrangement according to claim 19, wherein the side members are resiliently biassed towards a shield position in which they lie on opposed sides of the yarn guide means when the door is in the open position.

* * * * *